US005788301A

United States Patent [19]

Slomski

[11] Patent Number: 5,788,301

[45] Date of Patent: Aug. 4, 1998

[54] ONE-PIECE FOLDED TOP LIFT CARRIER

[75] Inventor: Edward J. Slomski, Crystal Lake, Ill.

[73] Assignee: Illinois Tool Works Inc., Glenview, Ill.

[21] Appl. No.: 747,621

[22] Filed: Nov. 13, 1996

[51] Int. Cl.[6] ..... B65D 71/00

[52] U.S. Cl. ..... 294/87.2; 294/159; 206/150; 206/151

[58] Field of Search ..... 294/87.2, 145, 294/159, 160; 206/150, 151, 161, 162, 199; 220/DIG. 29

[56] References Cited

U.S. PATENT DOCUMENTS

| | | | |
|---|---|---|---|
| 2,650,128 | 8/1953 | Failor . | |
| 2,994,426 | 8/1961 | Blesecker et al. . | |
| 3,038,602 | 6/1962 | Rapata . | |
| 3,232,422 | 2/1966 | Whyte | 294/87.2 |
| 3,383,827 | 5/1968 | Schaich . | |
| 3,608,949 | 9/1971 | Owen | 294/87.2 |
| 3,738,698 | 6/1973 | Helms . | |
| 3,744,704 | 7/1973 | Struble . | |
| 3,815,732 | 6/1974 | Klygis et al. . | |
| 3,815,947 | 6/1974 | Olsen | 294/87.2 |
| 3,868,140 | 2/1975 | Gordon . | |
| 4,218,086 | 8/1980 | Klygis . | |
| 4,447,479 | 5/1984 | Harrison et al. . | |
| 4,793,647 | 12/1988 | Marvin | 294/87.2 |
| 4,913,693 | 4/1990 | Ball et al. . | |
| 5,115,910 | 5/1992 | Klygis et al. . | |
| 5,174,441 | 12/1992 | Marco . | |
| 5,193,673 | 3/1993 | Rathbone et al. . | |
| 5,265,718 | 11/1993 | Marco . | |
| 5,437,364 | 8/1995 | Broskow . | |
| 5,487,465 | 1/1996 | Broskow . | |
| 5,609,379 | 3/1997 | Harrelson | 294/87.2 |
| 5,642,808 | 7/1997 | Marco et al. | 206/150 |
| 5,655,654 | 8/1997 | Broskow | 294/87.2 |

*Primary Examiner*—Dean Kramer
*Attorney, Agent, or Firm*—Trexler, Bushnell, Giangiorgi & Blackstone, Ltd.

[57] ABSTRACT

A novel plastic carrier for carrying a plurality of containers and a method of forming same is provided by the present invention. The carrier includes a handle portion being of a single ply of plastic material and a pair of container engaging portions freely depending from the handle portion at a joint. Each engaging portion has a plurality of apertures therethrough for carrying an associated container. One of the engaging portions is integrally formed with the handle portion and the other engaging portion is joined thereto at the joint. The carriers are preferably formed continuously. To form the carrier, first and second container engaging portions and the handle portion are stamped out of a single sheet of plastic material, and zipper strips, if provided, are formed thereon. The engaging portions are connected together and the second engaging portion and the handle portion are connected together. Thereafter, the first engaging portion is folded over onto the second engaging portion along a fold line. The first and second engaging portions are welded together along an edge thereof opposite to the fold line. Next, the fold line is severed. Finally, the completed carriers are collected onto a roll. A plurality of apertures may be formed during the stamping step or may be stamped after the container engaging portions are folded over onto each other.

10 Claims, 2 Drawing Sheets

ONE-PIECE FOLDED TOP LIFT CARRIER

BACKGROUND OF THE INVENTION

This invention is generally directed to a plastic, top-lift carrier for carrying container such as bottles, cans and the like. More particularly, the invention contemplates a plastic, top-lift carrier which has a handle portion that is formed of a single ply of plastic material and has a first container engaging portion integrally formed therewith and a second container engaging portion attached thereto at a joint. The carrier of the present invention is formed by a novel method disclosed herein.

U.S. Pat. No. 5,487,465, which is commonly owned by the assignee herein, discloses a plastic carrier for carrying containers, such as cans, bottles and the like. The carrier is formed from two webs of plastic material juxtaposed over one another and stamping the handle portion and the container engaging portion out of the web simultaneously. The webs are heat sealed across the juncture between the handle portion and the container engaging portion to form a weld. The resulting handle portion has a double thickness and the container engaging portions freely depend from the handle portion. Because of the construction, the handle portion is of a double thickness which wastes material and the carrier portions must be symmetrical about the carrier centerline.

The present invention provides a novel top-lift carrier which has a handle portion that is of a single thickness. Several other advantages are also presented by the carrier disclosed herein.

OBJECTS AND SUMMARY OF THE INVENTION

An object of the present invention is to provide a novel plastic, top lift carrier which is formed from a handle portion and a pair of container engaging portions which freely depend from the handle portion, wherein the handle portion is of a single ply of plastic material.

Yet another object of the present invention is to provide a novel plastic, top lift carrier which has a container engaging portions that need not necessarily be identical on both sides of the carrier.

A further object of the present invention is to provide a novel top lift carrier which has a handle portion that may be printed on both sides thereof.

Briefly, and in accordance with the foregoing, the present invention discloses a novel carrier and a novel method of forming same. The carrier is used to carry a plurality of containers, such as cans, bottles and the like.

The carrier includes a handle portion being of a single ply of plastic material and a pair of container engaging portions freely depending from the handle portion at a joint. Each container engaging portion has a plurality of apertures therethrough for carrying an associated container. One of the container engaging portions is integrally formed with the handle portion and the other container engaging portion is joined thereto at the joint. Each container engaging portion may have a zipper strip on the respective outer margins for releasing containers held within the apertures in the container engaging portion. The zipper strips may be identical or dissimilar in construction.

The carriers are preferably formed continuously. To form the carrier, first and second container engaging portions and the handle portion are stamped out of a single sheet of plastic material. The container engaging portions are connected together and the second container engaging portion and the handle portion are connected together. Thereafter, the first container engaging portion is folded over onto the second container engaging portion by suitable means along a fold line. The first and second container engaging portions are welded together along an edge thereof opposite to the fold line by suitable means, such as heat sealing. A plurality apertures are then stamped through the overlapping container engaging portions and the fold line is severed. Finally, the completed carriers are collected onto a roll.

Zipper strips may be formed during the first stamping step or during the second stamping step. If it is desired that the zipper strips be dissimilar in construction, then the zipper strips must be formed during the first stamping step while the container engaging portions are not folded over onto each other. If it is desired that the zipper strips be identical, then the zipper strips can be formed during either of the first or second stamping steps.

In addition, the carrier can be printed on by suitable means to print on one side of the handle portion and/or the container engaging portions or on both sides of the handle portion in registration and/or the container engaging portions in registration. This provides another advantage over prior art carriers that cannot be easily printed on.

The resulting carrier has a handle portion of a single ply of plastic material which eliminates the second ply found in prior art carriers.

BRIEF DESCRIPTION OF THE DRAWINGS

The organization and manner of the structure and operation of the invention, together with further objects and advantages thereof, may best be understood by reference to the following description, taken in connection with the accompanying drawings, wherein like reference numerals identify like elements in which:

FIG. 1 is a perspective view of a carrier which incorporates the features of the invention shown surrounding a plurality of containers, such as cans or the like;

DETAILED DESCRIPTION OF THE PREFERRED EMBODIMENT

Figure 1:
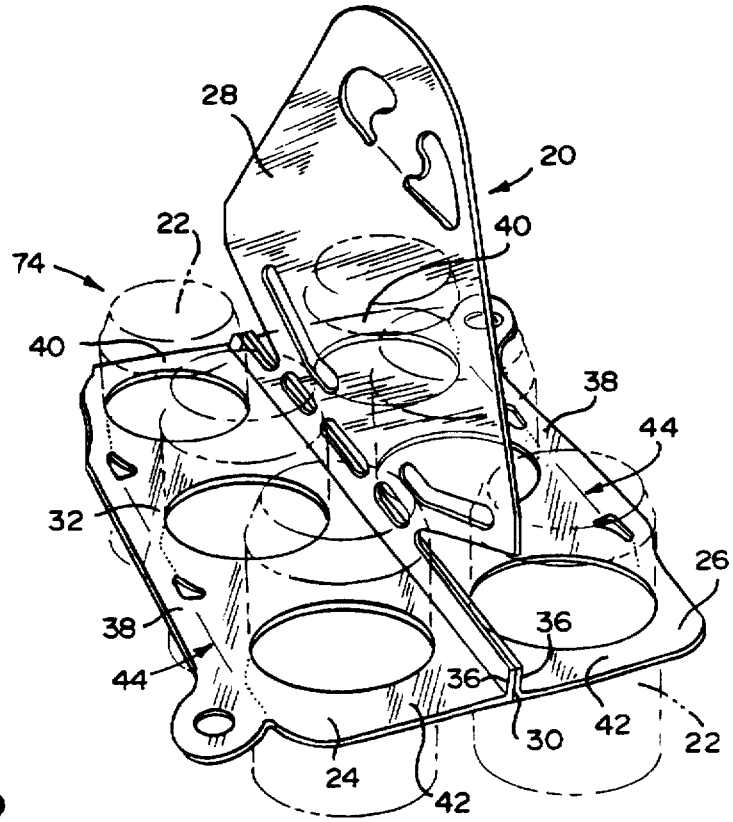

While the invention may be susceptible to embodiment in different forms, there is shown in the drawings, and herein will be described in detail, a specific embodiment with the understanding that the present disclosure is to be considered an exemplification of the principles of the invention, and is not intended to limit the invention to that as illustrated and described herein.

In FIG. 1, a novel, top-lift carrier 20 which incorporates features of the present invention is shown. The carrier 20 is used for carrying containers 22, such as cans, bottles and the like.

The novel carrier 20 is formed from a first container engaging portion 24 and a second container engaging portion 26, each of which freely depends from a handle portion 28 at a joint 30. The carrier 20 of the present invention is formed by a novel method as described herein. As a result of the method used to construct the carrier 20 of the present invention, the handle portion 28 can be pre-printed on both sides and also permits the design of the carrier 20 to have features that are not necessarily identical on each side of the centerline of the carrier 20.

The carrier 20 is made of a suitable flexible, resilient, stretchable material, such as plastic, preferably, low density polyethylene. The material is such that the carrier 20 can be stretched over the containers 22 by a jaw stretching machine and can conform to the side walls of the containers 22. The carrier 20 may be applied to the containers 22 by known means, for example, by the jaw stretching machines disclosed in U.S. Pat. Nos. 4,250,682 or 3,204,386. The second container engaging portion 24 and the handle portion 28 are integrally formed out of the same ply of plastic material. The first container engaging portion 26 is formed from a second ply of plastic material as described herein and is joined to the ply having the second container engaging portion 24 and the handle portion 28 formed therein at the joint 30.

Each container engaging portion 24, 26 includes a plurality of annular rings or bands 32. The annular bands 32 define a plurality of shaped apertures 34 for securely holding the containers 22 therein. Each container engaging portion 24, 26 has a first, inner margin 36, a second, outer margin 38 opposite to said first margin 26 and opposite side margins 40, 42. The first margin 36 of the second container engaging portion 24 is integrally connected to the handle portion 28 as described herein.

Each second, outer margin 38 may have a zipper strip 44 thereon which may be formed in accordance with and is fully disclosed in co-pending United States patent application Ser. No. 08/608,522 now U.S. Pat. No. 5,642,808 which is commonly owned by the assignee herein and which disclosure is herein incorporated by reference. Because of the method used to form the novel carrier 20 of the present invention, the carrier 20 presents an improvement to the carrier disclosed in co-pending Ser. No. 08/608,522 now U.S. Pat. No. 5,642,808 as the design of the carrier 20 of the present invention permits it to have features that are not necessarily identical on each side of the carrier centerline as is necessary in co-pending application Ser. No. 08/608,522 now U.S. Pat. No. 5,642,808. For example, the design of this carrier 20 permits the zipper strip 44 to be designed to be opened from either the same direction on both sides of the carrier 20 or different directions on each side of the carrier 20. This carrier 20 also permits a UPC flap (not shown) to be on one second, outer margin 38 of one container engaging portion, for example, the first container engaging portion 24, and not on the second, outer margin 38 of, for example, the second container engaging portion 24.

A preferred embodiment of the handle portion 28 has a body portion 46 having grasping means 48, shown as a pair of apertures and an elongated slit therebetween, provided through an upper portion of the body portion 46 proximate one edge of the body portion 46 so that a user's hand can be inserted through the grasping means 48 to grasp the handle portion 28. Also, in a preferred embodiment, a plurality of spaced bridge portions 50 are provided on the opposite edge of the body portion 46 and integrally connect the second container engaging portion 26 thereto. In addition, a plurality of openings 52 are formed through the body portion 46, one of each being between adjacent bridge portions 50.

In finished form, the first and second container engaging portions 24, 26 are connected or joined together by a continuous seam or joint 30 along the first, inner margins 36 of each container engaging portion 24, 26. The joint 30 runs the length of the container engaging portions 24, 26 and the container engaging portions 24, 26 freely depend from the joint 30. When the carrier 20 is not assembled with containers 22, the carrier 20 is flat and the joint 30 lies in generally the same plane as the container engaging portions 24, 26. The joint 30 projects generally perpendicular to the plane of the container engaging portions 24, 26 when the carrier 20 is assembled with containers 22.

Now that the specifics of the carrier 20 have been described, a general description of the method for making the carrier 20 is described. The method for making the carrier 20 is schematically illustrated in FIG. 4 in a simplified form.

The carrier 20 is preferably formed continuously. A roll 54 of plastic material provides a web 56 to form the carrier 20. The web 56 may be made of a natural, tinted or pigmented color.

Initially, the web of material 56 is printed on by a suitable printing means 58. The web 56 can be printed on one side or both sides thereof in registration so as to provide printing on one or both sides of the handle portion 28 and/or the container engaging portions 24, 26.

Figure 2:
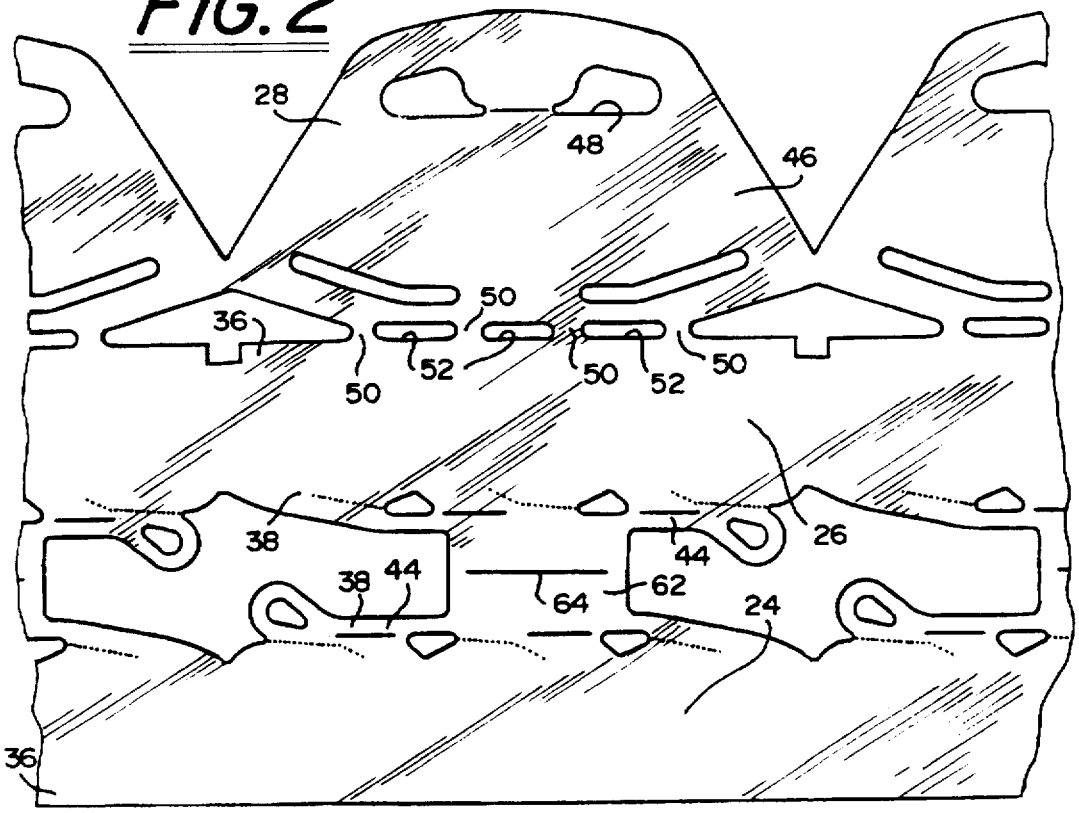
FIG. 2 is a top plan view of a plurality of carriers joined together after a step in the method shown in FIG. 4 is performed.
Figure 3:
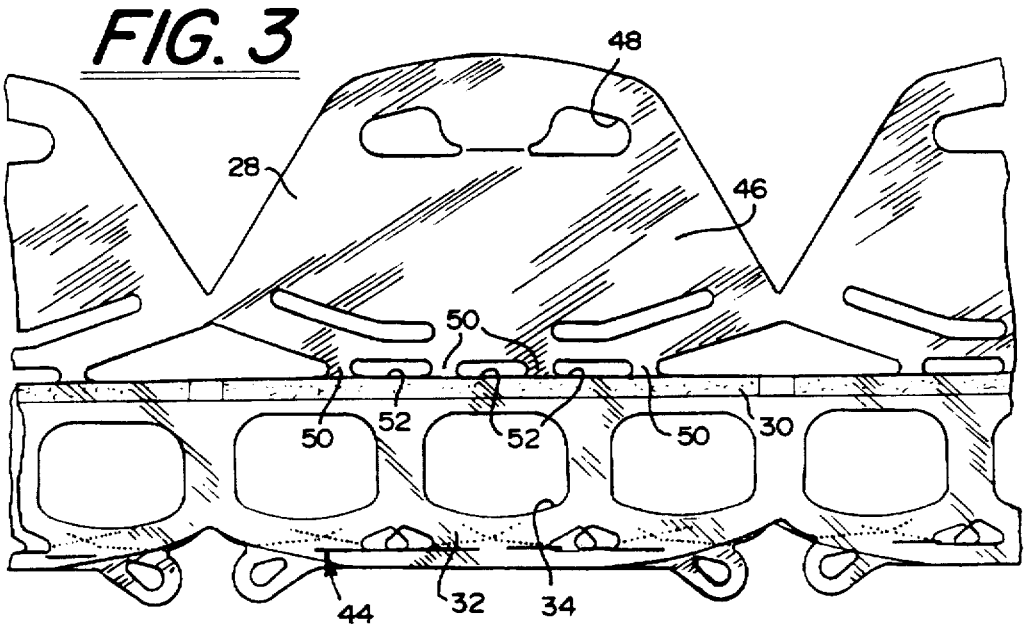
FIG. 3 is a top plan view of a plurality of carriers joined together after a further step in the method shown in FIG. 4 is performed.
Figure 4:
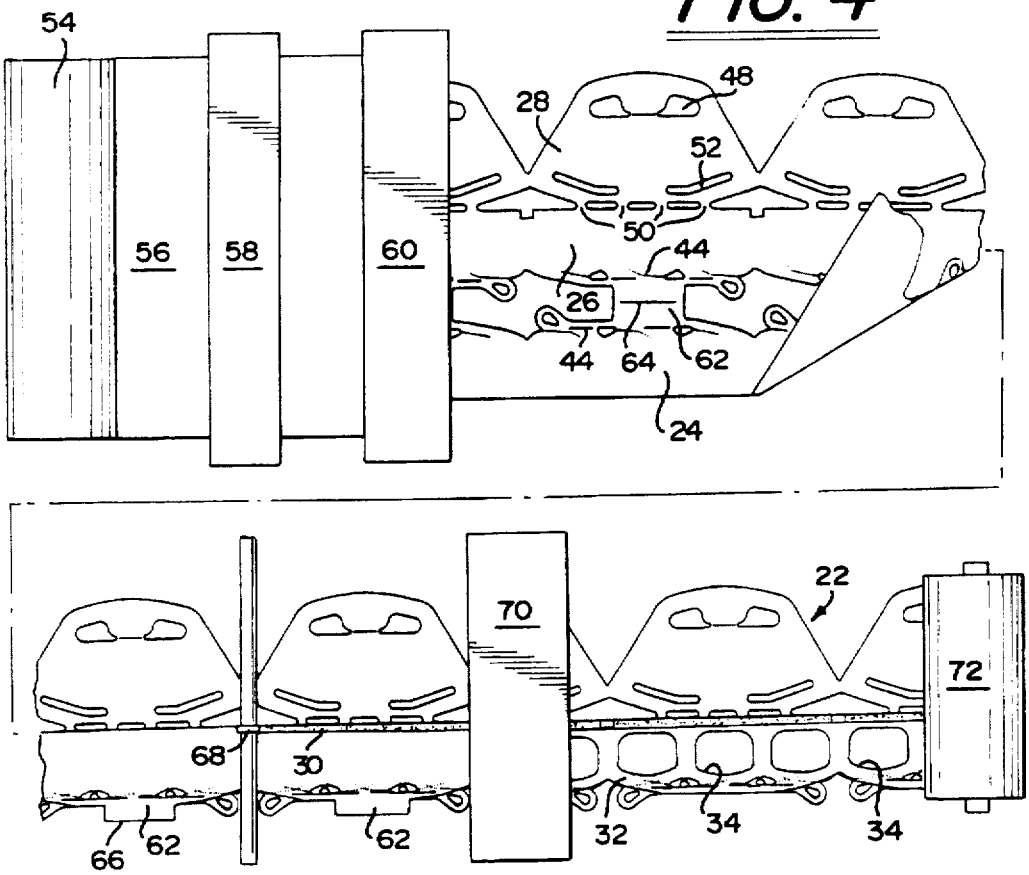
FIG. 4 is a schematic view of the steps used to form the carrier of the present invention.

The web 56 is then stamped or punched by a first punch press die 60 of known construction, to form continuous strips of the flat, partially completed carrier 20 as shown in FIGS. 2 and 4. After being stamped or punched by the punch press die 60, the handle portion 28 is completely formed such that the body portion 46, having the grasping means 48 and apertures 52 formed therein, and the bridge portions 50 are formed. The second container engaging portion 26 is formed with the exception of the apertures 34 and is integrally connected to the bridge portions 50 at the first margin 36 thereof. The first container engaging portion 24 is formed with the exception of the apertures 34 and its second margin 38 is integrally connected to the second margin 38 of the second container engaging portion 26 by means of a bridge portion 62. The bridge portion 62 preferably has an elongated slot 64 punched through approximately the center of the bridge portion 62 at the same time it is formed. In addition, the features of the zipper strips 44 are formed on each second margin 38 of each container engaging portion 24, 26. Because the zipper strips 44 are stamped into the carrier 20 while it is flat, the zipper strips 44 may be dissimilar in construction or may be like in construction. In addition, any combination of UPC flaps or opening features can be designed into the container engaging portion 24. After the punch press step, each carrier 20 is integrally connected to the adjacent carrier 20 at the sides thereof.

Next, the first container engaging portion 24 is folded over onto the second container engaging portion 26 by suitable, known means and overlapped onto the second container engaging portion 26 such that the first margins 36 align with each other. The handle portion 28 is not overlapped by the first container engaging portion 24. The first container engaging portion 24 is folded over onto the second container engaging portion 26 along fold line 66 which aligns with slot 64. The slot 64 aids in folding the plastic material from which the carrier 20 is made.

Subsequently, the first margins 36 of the first and second container portions 24, 26 are joined or welded along the length thereof by suitable means, such as heat sealing, to form joint 30. The heat sealing may be done by conventional, known methods, such as by a heated roller 68. It should also be recognized that in some cases, a strip of heat sensitive or pressure sensitive adhesive may be inserted at desired locations between the container engaging portions 24, 26 to secure the first margins 36 together.

Thereafter, the flat, folded carrier 20 is passed under a second punch press die 70. During this step, the apertures 34 are punched through both the first and second container engaging portions 24, 26 simultaneously and the bridge portion 62 is severed from the second margins 38 of the container engaging portions 24, 26. When the bridge portion 62 is severed therefrom, the container engaging portions 24, 26 are no longer connected to each other and can be freely moved away from each other.

While the preferred method includes punching apertures 34 in a second punch press step to ensure accurate registration of such apertures 34, the apertures 34 could be created during the first punch step with careful alignment of the apertures prior to the heat sealing step.

The flat, continuous web of completed carriers 20 are then collected on a roll 72 or otherwise appropriately stored until they are to be applied to containers by known methods.

It is to be understood that variations on the method for forming the carrier 20 may be performed. For example, the printing may be done after the first punch press die 60 has punched the web 56. In addition, the first punch press die 60 can be used to form the apertures 34. Alternatively, the second punch press die 70 can be used to form the zipper strips 44, but this will form identical zipper strips on each side of the carrier 20 as the zipper strips would be punched simultaneously through both of the container engaging portions 24, 26.

To use the carrier 20 to carry containers 22 and form a package 74 as shown in FIG. 1, an individual carrier 20 is separated from the roll 72 by suitable means. The container engaging portions 24, 26 are pivoted so as to be generally perpendicular to the handle portion 28 and are then stretched over the containers 22 using known means. To carry the package 70, the handle portion 28 extends upwardly between the rows of containers 22 and is generally perpendicular to the container engaging portions 24, 26 of the carrier 20.

While a preferred embodiment of the present invention is shown and described, it is envisioned that those skilled in the art may devise various modifications of the present invention without departing from the spirit and scope of the appended claims.

The invention claimed is:

1. A plastic carrier for carrying a plurality of containers comprising: a handle portion being of a single ply of plastic material; and a pair of container engaging portions freely depending from said handle portion at a joint, each said plastic container engaging portion having a plurality of apertures therethrough reach said aperture for carrying an associated container, one of said container engaging portions being integrally formed with said handle portion and the other of said container engaging portion being joined to said handle portion at said joint.

2. A carrier as defined in claim 1, wherein each said container engaging portion has an outer margin and further has a zipper strip on each said outer margin for releasing containers held within said apertures in said container engaging portion.

3. A carrier as defined in claim 2, wherein said zipper strips are dissimilar in construction.

4. A carrier as defined in claim 1, wherein said handle portion is printed on both sides.

5. A method of forming a carrier for use in carrying a plurality of containers comprising the steps of:

providing a single sheet of plastic material;

stamping a first container engaging portion, a second container engaging portion and a handle portion out of said single sheet of plastic material, said first and second container engaging portions being connected together and said second container engaging portion and said handle portion being connected together;

folding said first container engaging portion over onto said second container engaging portion along a fold line such that said first container engaging portion overlaps said second container engaging portion;

welding said first container engaging portion and said second container engaging portion together along an edge thereof opposite to said fold line;

separating said container engaging portions from each other adjacent said fold line.

6. A method as defined in claim 5, wherein a plurality of carriers are formed continuously such that each carrier is joined to adjacent carriers.

7. A method as defined in claim 6, further including the step of collecting said completed carriers onto a roll.

8. A method as defined in claim 5, wherein during said step of stamping said container engaging portions and said handle portion, a zipper strip is formed on each container engaging portion along an edge which is proximate to the subsequently formed fold line.

9. A method as defined in claim 5, wherein during said step of stamping said container engaging portions and said handle portion, a plurality of apertures are stamped in each carrier engaging portion.

10. A method as defined in claim 5, further including the step of stamping a plurality of apertures through said overlapped container engaging portions.

* * * * *

UNITED STATES PATENT AND TRADEMARK OFFICE

CERTIFICATE OF CORRECTION

PATENT NO. : 5,788,301

DATED : August 4, 1998

INVENTOR(S) : Edward J. Slomski

It is certified that error appears in the above-indentified patent and that said Letters Patent is hereby corrected as shown below:

Column 5, Line 50 "reach" should be --,each --

Signed and Sealed this

Twenty-third Day of March, 1999

*Attest:*

Q. TODD DICKINSON

*Attesting Officer*

*Acting Commissioner of Patents and Trademarks*